US006376988B1

(12) United States Patent
Mukai et al.

(10) Patent No.: US 6,376,988 B1
(45) Date of Patent: Apr. 23, 2002

(54) DISCHARGE LAMP FOR AUTOMOBILE HEADLIGHT AND THE AUTOMOBILE HEADLIGHT

(75) Inventors: Kenji Mukai; Hideaki Kiryu, both of Osaka; Tetsuji Takeuchi, Kyoto; Takeshi Saitoh, Hyogo, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/363,764

(22) Filed: Jul. 29, 1999

(30) Foreign Application Priority Data

Aug. 28, 1998 (JP) ..... 10-244032

(51) Int. Cl.[7] ..... H01J 61/16; H01J 61/30

(52) U.S. Cl. ..... 313/641; 313/638; 313/620; 313/637

(58) Field of Search ..... 313/567, 570, 313/571, 572, 579, 576, 635, 637, 638, 639, 640, 641, 642, 643, 620

(56) References Cited

U.S. PATENT DOCUMENTS

| | | | | | |
|---|---|---|---|---|---|
| 4,634,927 | A | * | 1/1987 | Mori et al. | 313/486 |
| 4,709,184 | A | | 11/1987 | Keeffe et al. | 313/638 |
| 4,823,049 | A | | 4/1989 | Sanders et al. | 313/623 |
| 5,159,229 | A | * | 10/1992 | Passmore et al. | 313/25 |
| 5,363,007 | A | | 11/1994 | Fromm et al. | 313/25 |
| 5,394,057 | A | * | 2/1995 | Russell et al. | 313/635 |
| 5,646,472 | A | | 7/1997 | Horikoshi | 313/112 |
| 5,955,846 | A | * | 9/1999 | Kominami et al. | 315/268 |
| 6,211,616 | B1 | * | 4/2001 | Takeuti et al. | 313/637 |
| 6,242,851 | B1 | * | 6/2001 | Zhu et al. | 313/25 |
| 6,265,827 | B1 | * | 7/2001 | Takahashi et al. | 313/638 |
| 2001/0000121 | A1 | * | 4/2001 | Tanaka et al. | 313/635 |

FOREIGN PATENT DOCUMENTS

| | | | | |
|---|---|---|---|---|
| EP | 762474 | | 3/1997 | |
| EP | 1063681 | * | 12/2000 | H01J/61/12 |
| JP | 56-91368 | * | 7/1981 | H01J/61/16 |
| JP | 5-290804 | | 11/1993 | |
| JP | 5-325895 | | 12/1993 | |
| JP | 7-130331 | | 5/1995 | |
| JP | 7-192695 | | 7/1995 | |
| JP | 8-111206 | | 4/1996 | |

OTHER PUBLICATIONS

1993, T. Yano "The Effect of Correlated Color Temperature on Discomfort Glare for the Aged" *Journal of Illumination Society*, vol. 77, No. 6, pp. 296–303.

* cited by examiner

*Primary Examiner*—Nimeshkumar D. Patel
*Assistant Examiner*—Karabi Guharay
(74) *Attorney, Agent, or Firm*—Merchant & Gould PC

(57) ABSTRACT

A discharge lamp for an automobile headlight has a light color that lies in a region common to the following three regions: a region bounded by an ellipse with a color point (u, v)=(0.224, 0.331) as a center thereof, a major axis of 0.080, a minor axis of 0.024, and an angle from a u axis of 35 degrees in the CIE 1960 UCS diagram; a region bounded by an ellipse with a color point (u, v)=(0.220, 0.332) as a center thereof, a major axis of 0.060, a minor axis of 0.022, and an angle from a u axis of 15 degrees in the CIE 1960 UCS diagram; and a region bounded by an ellipse with a color point (u, v)=(0.235, 0.335) as a center thereof, a major axis of 0.060, a minor axis of 0.030, and an angle from a u axis of 30 degrees in the CIE 1960 UCS diagram. The light color lies in a range on a side of color temperature lower than an isotemperature line of a correlated color temperature of 3800K and higher than an isotemperature line of a correlated color temperature of 3400K in the CIE 1960 UCS diagram.

30 Claims, 14 Drawing Sheets

DISCHARGE LAMP FOR AUTOMOBILE HEADLIGHT AND THE AUTOMOBILE HEADLIGHT

BACKGROUND OF THE INVENTION

1. Field of the Invention

The present invention relates to a discharge lamp for an automobile headlight and to the automobile headlight.

2. Description of the Prior Art

Conventionally, a halogen lamp generally has been used in an automobile headlight. Recently, a headlight employing a high pressure discharge lamp (referred to as a HID headlight) has been increasingly widespread as a headlight that can achieve energy saving and improved brightness. The HID headlight can illuminate forward more brightly with a small amount of power than a headlight employing a halogen lamp. On the other hand, the brightness of the HID headlight dazzles and causes uncomfortable glare to the drivers in the automobiles running in the opposite direction. This may lead to a car accident. Therefore, a headlight that illuminates forward brightly and hardly causes undesired glare is desired.

The uncomfortable glare can be alleviated by reducing the intensity of light of the headlight toward the opposing automobile, or lowering the correlated color temperature of the light source. The former approach is not desirable because the illumination in the forward direction is reduced. One example of the latter approach may be to use a high pressure discharge lamp with a low correlated color temperature such as a high pressure sodium lamp. However, the high pressure sodium lamp emits yellowish light and has a low color rendering property, thereby interfering with the recognition of the safety color of road marking or traffic signs, although a risk of car accidents may be smaller.

For a conventional metal halide lamp for an automobile headlight, a luminous tube lamp having an outer tube including a multi-layered interference film formed on the surface thereof has a color temperature of more than 4000K has been proposed to obtain, for example, a low color temperature of 2000 to 4000K that is close to the color of an incandescent lamp (Japanese Laid-Open Patent Publication No. 5-325895). Furthermore, for a conventional metal halide lamp, a luminous tube lamp having a correlated color temperature of 2800 to 3700K that has a color close to the color of blackbody radiation has been proposed (Japanese Laid-Open Patent Publication No. 7-130331).

However, the above-described discharge lamps have a problem in that they fail to provide a color discrimination (identification) property as good as or similar to that of a fluorescent lamp used for intramural illumination.

Furthermore, for a conventional metal halide lamp, a luminous tube enclosing a metal halide and argon gas therein has been proposed (Japanese Laid-Open Patent Publication Nos. 7-320688, 7-130331, 62-131459, 61-64060, and 5-205697).

However, these conventional metal halide lamp have poor luminous flux rising characteristics, so that they fail to illuminate forward immediately after they are switched on. Therefore, they are not suitable for a discharge lamp for an automobile.

SUMMARY OF THE INVENTION

Therefore, with the foregoing in mind, it is an object of the present invention to provide a discharge lamp for headlights that hardly creates uncomfortable glare and provides easier discrimination of various colors including the safety color, and a headlight employing such a discharge lamp.

In order to achieve the object, a first discharge lamp of the present invention includes a luminous tube in which xenon gas is sealed, and has a light color that lies in a chromatic region common to the following regions: a region bounded by an ellipse with a color point (u, v)=(0.224, 0.331) as the center thereof, a major axis of 0.080, a minor axis of 0.024, and an angle from the u axis of 35 degrees in the CIE 1960 UCS diagram; a region bounded by an ellipse with a color point (u, v)=(0.220, 0.332) as the center thereof, a major axis of 0.060, a minor axis of 0.022, and an angle from the u axis of 15 degrees in the CIE 1960 UCS diagram; and a region bounded by an ellipse with a color point (u, v)=(0.235, 0.335) as the center thereof, a major axis of 0.060, a minor axis of 0.030, and an angle from the u axis of 30 degrees in the CIE 1960 UCS diagram. Herein, the CIE 1960 UCS diagram is a chromaticity diagram standardized in 1960 by the CIE (Commission Internationale de l'Eclarage in French), as defined in Japanese Industrial Standards (JIS) Z8105. The CIE 1960 UCS diagram is designed to allow measurement of color differences, and calibrated such that with respect to all points in the diagram, a difference in colors perceived by observers when viewing the colors having the same brightness is in proportion to a geometric distance in the diagram.

This embodiment provides a discharge lamp having a low color temperature that permits excellent color discrimination (identification) so that it is substantially comparable to a fluorescent lamp, which is used indoors and provides easy color recognition.

Next, a second discharge lamp of the present invention includes a luminous tube in which xenon gas is sealed, and has a light color that lies in a chromatic region common to the following regions: a region bounded by an ellipse with a color point (u, v)=(0.221, 0.329) as a center thereof, a major axis of 0.047, a minor axis of 0.014, and an angle from a u axis of 35 degrees in the CIE 1960 UCS diagram; a region bounded by an ellipse with a color point (u, v)=(0.224, 0.334) as a center thereof, a major axis of 0.040, a minor axis of 0.015, and an angle from a u axis of 15 degrees in the CIE 1960 UCS diagram; and a region bounded by an ellipse with a color point (u, v)=(0.236, 0.339) as a center thereof, a major axis of 0.037, a minor axis of 0.013, and an angle from a u axis of 30 degrees in the CIE 1960 UCS diagram.

This embodiment provides a discharge lamp having a low color temperature range that permits excellent color discrimination (identification) so that it is substantially comparable to a fluorescent lamp, which is used indoors and provides easy color recognition.

In the first and the second discharge lamps of the present invention, the light color preferably lies in a range bounded by lines connecting four color points (u, v) of (0.221, 0.345), (0.252, 0.345), (0.248, 0.338), and (0.231, 0.330) in the CIE 1960 UCS diagram. This embodiment provides a discharge lamp whose light permits a white object such as white lines on roads to be perceived as "white" when it is illuminated, i.e., a discharge lamp having an excellent property to provide perception of white color.

In the first and the second discharge lamps of the present invention, the light color of the discharge lamp preferably lies in a range bounded by lines connecting three color points (u, v) of (0.224, 0.341), (0.244, 0.341), and (0.229, 0.333) in the CIE 1960 UCS diagram. This embodiment provides a discharge lamp whose light permits a white object such as white lines on roads to be perceived as particularly "white" when it is illuminated, i.e., a discharge lamp having a particularly excellent property to provide perception of white color.

In the first and the second discharge lamps of the present invention, the color point of the light color preferably lies in a range on the side of color temperature lower than the isotemperature line of a correlated color temperature of 3800K in the CIE 1960 UCS diagram. This embodiment provides another advantage in that the illumination by the discharge lamp is less likely to be dazzling, in addition to the above-described advantages.

In another embodiment of the present invention, the color point of the light color lies in a range on the side of color temperature higher than the isotemperature line of a correlated color temperature of 3400K in the CIE 1960 UCS diagram. This embodiment provides further advantages in that the illumination by the discharge lamp is less likely to be dazzling, and that the color can be discriminated against the light color of a headlight employing a current halogen lamp, in addition to the above-described advantages.

In another embodiment of the present invention, any one of the discharge lamps as described above is used for an automobile headlight. Thus, the automobile headlight can be provided with the advantages described above.

In still another embodiment of the present invention, in any one of the discharge lamps as described above, preferably a metal halide is sealed in the luminous tube.

The discharge lamp of the present invention preferably comprises at least a pair of electrodes. The distance d between the ends of the electrodes is preferably 8 mm or less, the inner diameter D of the luminous tube at the midpoint between the electrodes is preferably 5 mm or less, the power W supplied for illumination is preferably 70 W or less, and the lamp efficiency during illumination is preferably 501 m/W or more.

In another embodiment of the discharge amp of the present invention, the metal halide comprises a halide of sodium, and an amount of the halide of sodium sealed is preferably 50 wt % or more with respect to the total amount of the metal halide sealed.

In still another embodiment of the discharge lamp of the present invention, the metal halide comprises a halide of sodium and a halide of scandium, and does not comprise a halide of thorium nor a halide of thallium, and the following relationship is preferably satisfied:

$$90<W_{Na}+W_{Sc}, \text{ and}$$

$$0.75\leqq W_{Na}h/(W_{Sc}+W_{Na})<1,$$

where $W_{Na}$ and $W_{Sc}$ represent the percentages by weight of the halide of sodium sealed and the halide of scandium sealed, respectively, with respect to the total amount of the metal halide sealed.

In yet another embodiment of the discharge lamp of the present invention, the metal halide comprises a halide of sodium and a halide of thorium, and does not comprise a halide of thallium, and the following relationship is preferably satisfied:

$$90<W_{Na}+W_{Sc}+W_{Th}, \text{ and}$$

$$0.75\leqq W_{Na}/(W_{Sc}+W_{Na})-W_{Th}/(W_{Sc}+W_{Na}+W_{Th})<1,$$

where $W_{Na}$, $W_{Sc}$ and $W_{Th}$ represent the percentages by weight of the halide of sodium sealed, the halide of scandium sealed, and the halide of thorium sealed, respectively, with respect to the total amount of the metal halide sealed.

In another embodiment of the discharge lamp of the present invention, the metal halide comprises a halide of sodium, a halide of scandium and a halide of thallium, and does not comprise a halide of thorium, and the following relationship is preferably satisfied:

$$90<W_{Na}+W_{Sc}+W_{Tl},$$

$$0.75<W_{Na}/(W_{Sc}+W_{Na})<1, \text{ and}$$

$$W_{Tl}/(W_{Sc}+W_{Na}+W_{Tl})\leqq 0.03,$$

where $W_{Na}$, $W_{Sc}$ and $W_{Tl}$ represent the percentages by weight of the halide of sodium sealed, the halide of scandium sealed, and the halide of thallium sealed, respectively, with respect to the total amount of the metal halide sealed.

In still another embodiment of the discharge lamp of the present invention, the metal halide comprises a halide of sodium, a halide of scandium, a halide of thorium, and a halide of thallium, and the following relationship is preferably satisfied:

$$90<W_{Na}+W_{Sc}+W_{Th}+W_{Tl},$$

$$0.75<W_{Na}/(W_{Sc}+W_{Na})-W_{Th}/(W_{Sc}+W_{Na}+W_{Th})<1, \text{ and}$$

$$-0.05\leqq W_{Th}/(W_{Sc}+W_{Na}+W_{Th})-2\times W_{Tl}(W_{Sc}+W_{Na}+W_{Th}+W_{Tl}),$$

where $W_{Na}$, $W_{Sc}$, $W_{Th}$ and $W_{Tl}$ represent the percentages by weight of the halide of sodium sealed, the halide of scandium sealed, the halide of thorium sealed and the halide of thallium sealed, respectively, with respect to the total amount of the metal halide sealed.

In yet another embodiment of the discharge lamp of the present invention, the metal halide preferably comprises 10 wt % or less of a halide of cesium with respect to the total amount of the metal halide sealed.

In another embodiment of the discharge lamp of the present invention, the discharge lamp preferably comprises an outer tube having a linear transmittance for light at 350 nm of 30% or less and a linear transmittance for light at 450nm of 70% or more.

In still another embodiment of the discharge lamp of the present invention, the outer tube preferably seals at least one end of the luminous tube.

In yet another embodiment of the discharge lamp of the present invention, an inner diameter of the outer tube is preferably 12 mm or less.

The preferred embodiments of the present invention described above provides a discharge lamp that permits excellent color discrimination, is hardly dazzling, allows an illuminated white object to be perceived as being "white", and has a light color that is discriminated against the light color of a current halogen lamp. In addition, the discharge lamp can emit light with a constant color and luminous flux because the temperature at the coldest point of the luminous tube hardly change with illumination conditions.

These and other advantages of the present invention will become apparent to those skilled in the art upon reading and understanding the following detailed description with reference to the accompanying figures.

DESCRIPTION OF THE PREFERRED EMBODIMENTS

Hereinafter, experiments for obtaining chromatic ranges for light colors in which light from a light source allows appropriate perception of a colored object will be described.

First, experiments were conducted to study color discrimination (identification) for the colors used for traffic signs under various lamps having different colors of light emitted from the light sources. In the experiments, it is determined how easily observers can discern colors typically used for road sings and marking, i.e., red, blue and green. The observers judge a difference in colors of color charts for a target color by varying the color difference of the color.

Figure 2:
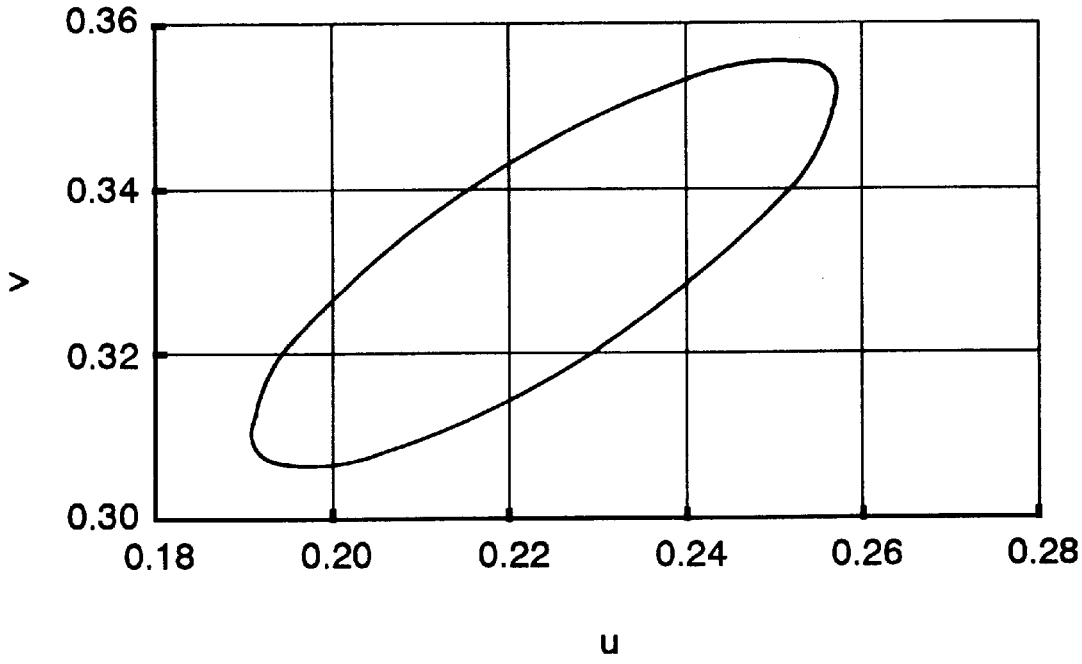
FIG. 2 is a diagram showing a chromatic range of colors of light sources that provide easy recognition of red color according to the CIE 1960 UCS diagram.

FIG. 2 shows the experimental results with respect to ease of discernment of red color. It was found that when the light color of a light source lies within a range bounded by an ellipse with a color point (u, v)=(0.224, 0.331) as its center, a major axis of 0.080, a minor axis of 0.024, and an angle from the u axis of 35 degrees in the CIE 1960 UCS diagram, 75% or more of the observers were able to discern colors whose color difference is at least 2 in the CIE 1976 L*a*b* color space.

Figure 3:
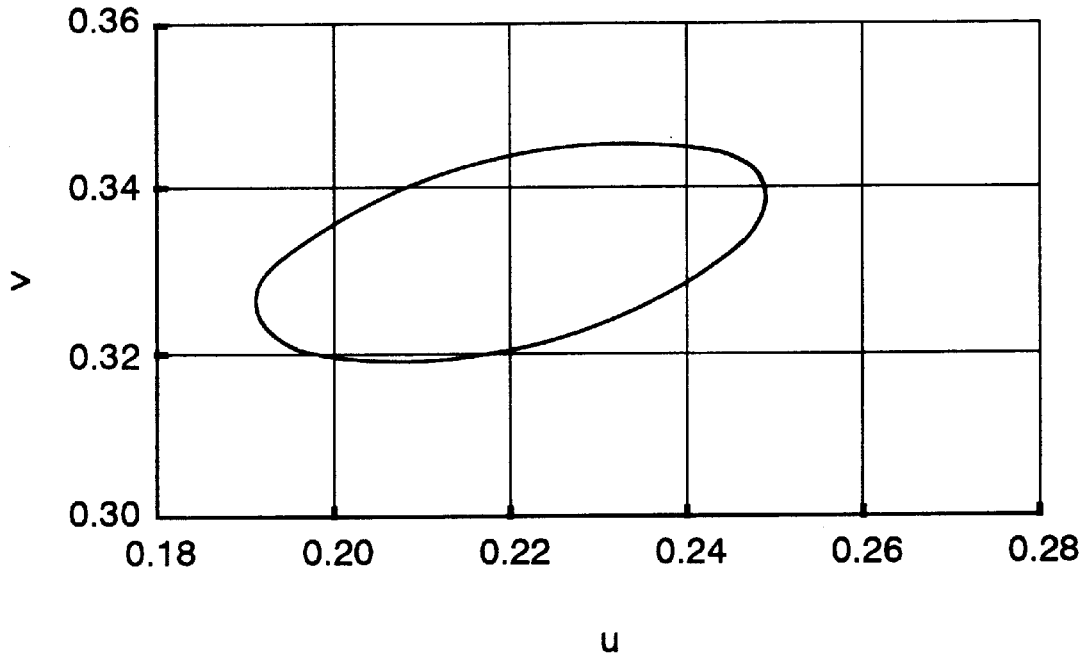
FIG. 3 is a diagram showing a chromatic range of colors of light sources that provide easy recognition of green color according to the CIE 1960 UCS diagram.

FIG. 3 shows the experimental results with respect to ease of discernment of green color. It was found that when the light color of a light source lies within a range bounded by an ellipse with a color point (u, v)=(0.220, 0.332) as its center, a major axis of 0.060, a minor axis of 0.022, and an angle from the u axis of 15 degrees in the CIE 1960 UCS diagram, 75% or more of the observers were able to discern colors whose color difference is at least 2 in the CIE 1976 L*a*b* color space.

Figure 4:
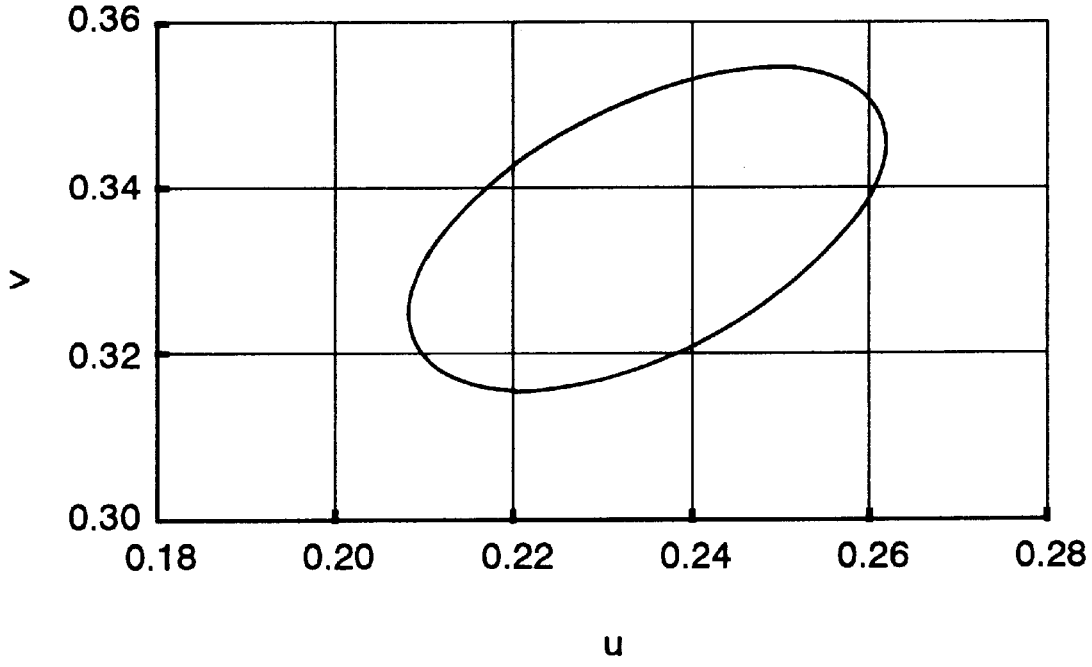
FIG. 4 is a diagram showing a chromatic range of colors of light sources that provide easy recognition of blue color according to the CIE 1960 UCS diagram.

FIG. 4 shows the experimental results with respect to ease of discernment of blue color. It was found that when the light color of a light source lies within a range bounded by an ellipse with a color point (u, v)=(0.235, 0.335) as its center, a major axis of 0.060, a minor axis of 0.030, and an angle from the u axis of 30 degrees in the CIE 1960 UCS diagram, 75% or more of the observers were able to discern colors whose color difference is at least 2 in the CIE 1976 L*a*b* color space.

Figure 5:
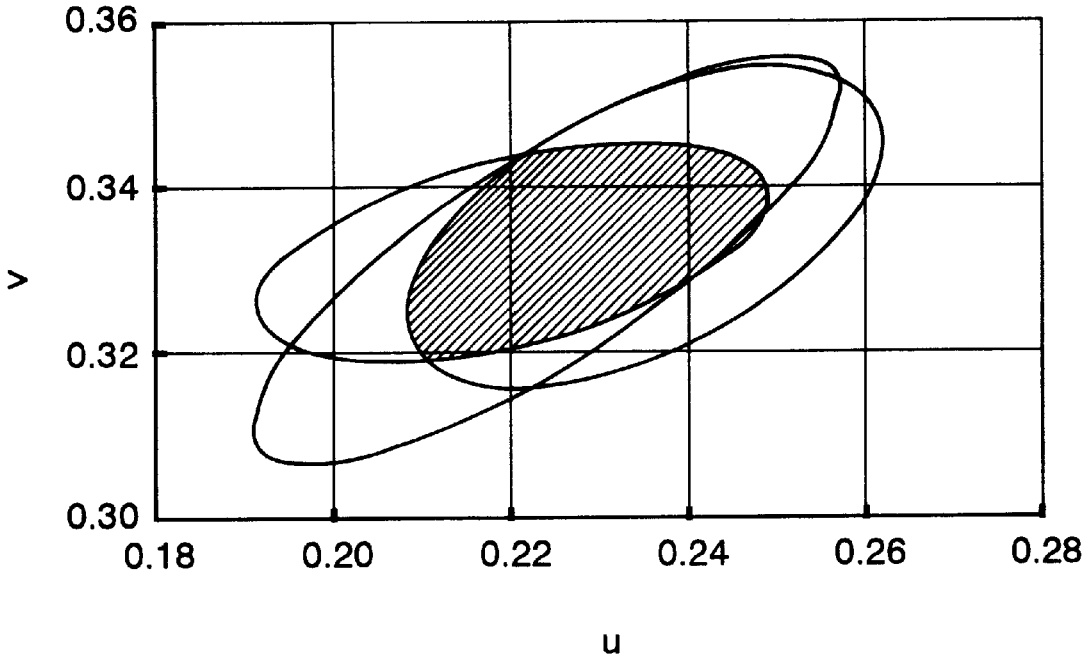
FIG. 5 is a diagram showing a chromatic range of colors of light sources that provide easy recognition of colors in all the categories according to the CIE 1960 UCS diagram.

In other words, it can be concluded that a light source emitting light whose color lies within a range common to all the ranges bounded by the three ellipses with respect to ease of discernment of red, blue and green colors obtained by the experiments provides excellent color discrimination for colors in substantially all the categories. The range common to all the ranges bounded by the three ellipses is shown as a hatched region in FIG. 5.

Figure 6:
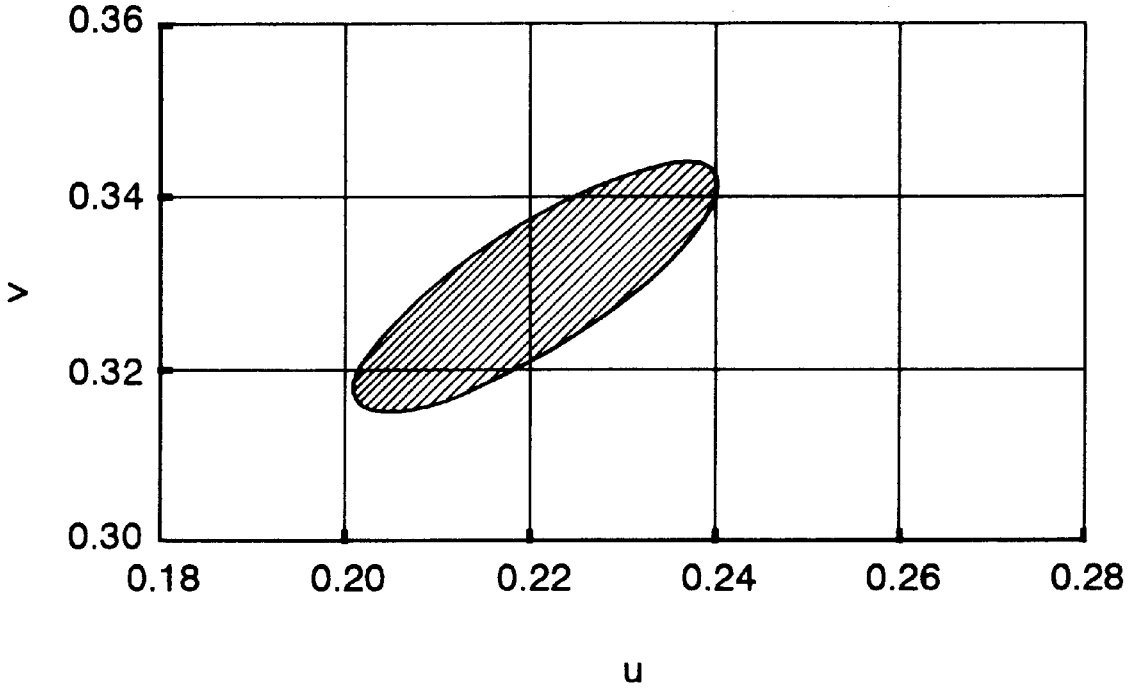
FIG. 6 is a diagram showing a chromatic range of colors of light sources that provide particularly easy recognition of red color according to the CIE 1960 UCS diagram.

FIG. 6 shows the experimental results with respect to ease of discernment of red color. It was found that when the light color of a light source lies within a range bounded by an ellipse with a color point (u, v)=(0.221, 0.329) as its center, a major axis of 0.047, a minor axis of 0.014, and an angle from the u axis of 35 degrees in the CIE 1960 UCS diagram, 85% or more of the observers were able to discern colors whose color difference is at least 2 in the CIE 1976 L*a*b* color space.

Figure 7:
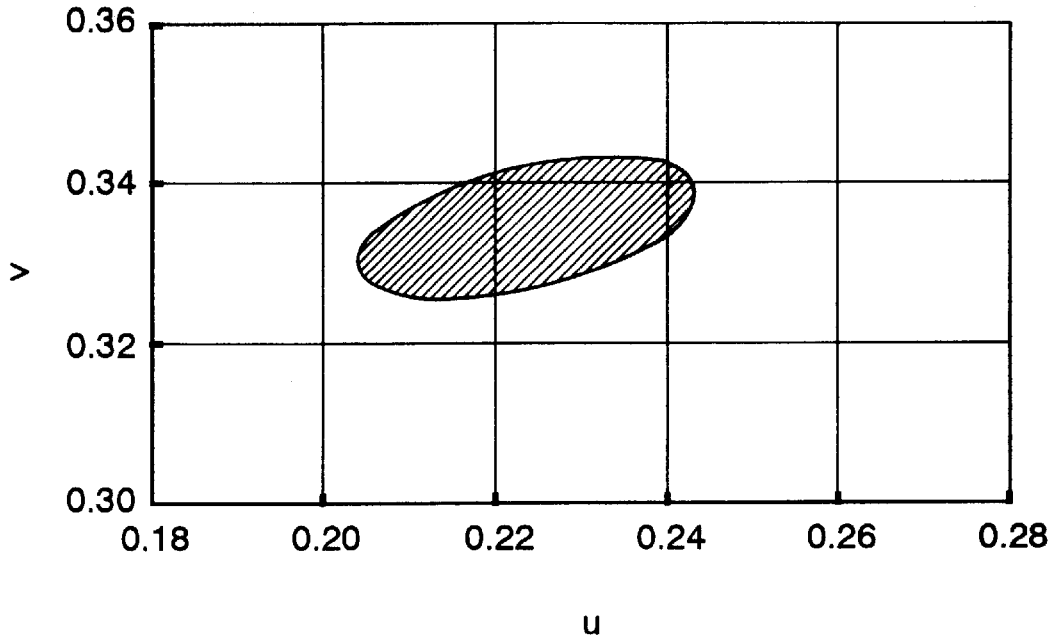
FIG. 7 is a diagram showing a chromatic range of colors of light sources that provide particularly easy recognition of green color according to the CIE 1960 UCS diagram.

FIG. 7 shows the experimental results with respect to ease of discernment of green color. It was found that when the light color of a light source lies within a range bounded by an ellipse with a color point (u, v)=(0.224, 0.334) as its center, a major axis of 0.040, a minor axis of 0.015, and an angle from the u axis of 15 degrees in the CIE 1960 UCS diagram, 85% or more of the observers were able to discern colors whose color difference is at least 2 in the CIE 1976 L*a*b* color space.

Figure 8:
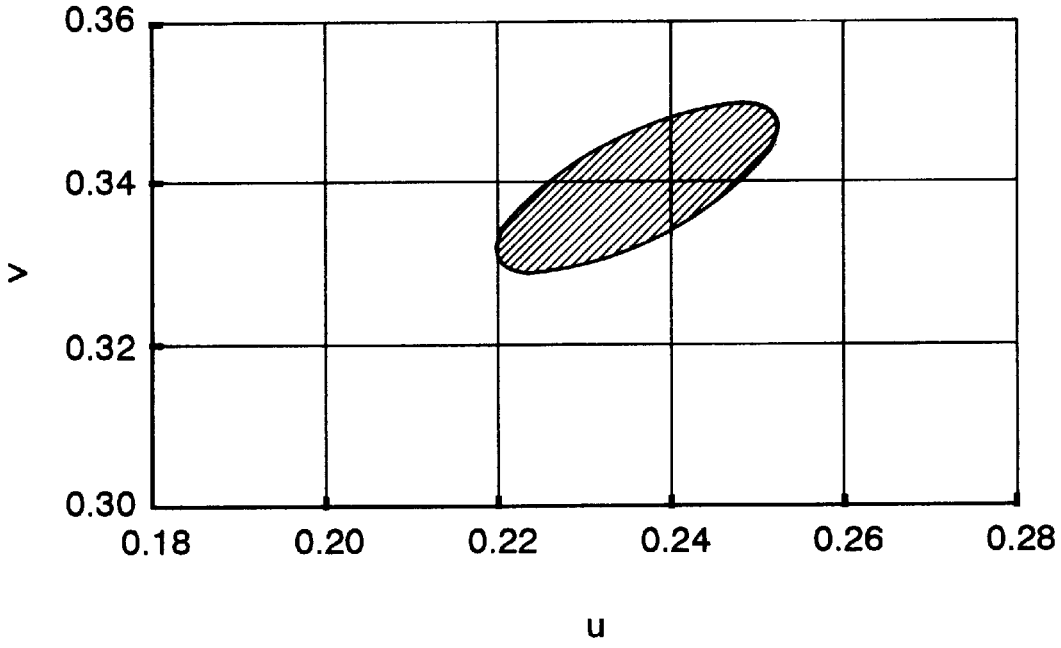
FIG. 8 is a diagram showing a chromatic range of colors of light sources that provide particularly easy recognition of blue color according to the CIE 1960 UCS diagram.

FIG. 8 shows the experimental results with respect to ease of discernment of blue color. It was found that when the light color of a light source lies within a range bounded by an ellipse with a color point (u, v)=(0.236, 0.339) as its center, a major axis of 0.037, a minor axis of 0.013, and an angle from the u axis of 30 degrees in the CIE 1960 UCS diagram, 85% or more of the observers were able to discern colors whose color difference is at least 2 in the CIE 1976 L*a*b* color space.

Figure 9:
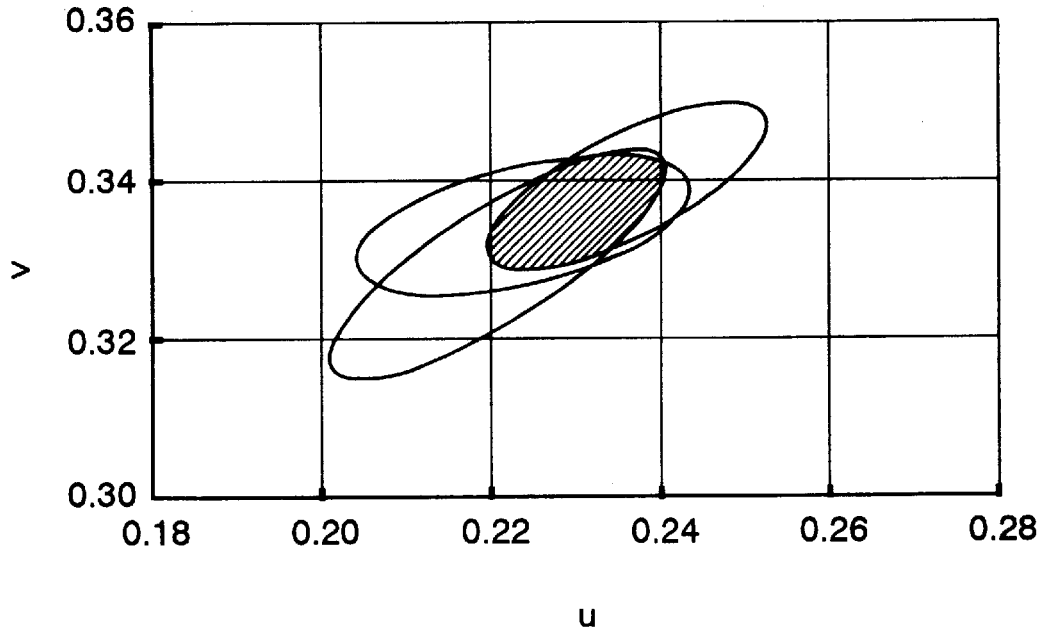
FIG. 9 is a diagram showing a chromatic range of colors of light sources that provide particularly easy recognition of colors in all the categories according to the CIE 1960 UCS diagram.

In other words, it can be concluded that a light source emitting light whose color lies within a range common to all the ranges bounded by the three ellipses with respect to ease of discernment of red, blue and green colors obtained by the experiments provides excellent color discrimination for colors in substantially all the categories. The range common to all the ranges bounded by the three ellipses is shown as a hatched region in FIG. 9.

Next, experiments are conducted with respect to perception of white color when observing an object of an achromatic color illuminated by various lamps having different light source colors that have a correlated color temperature of 4000K or less.

Figure 10:
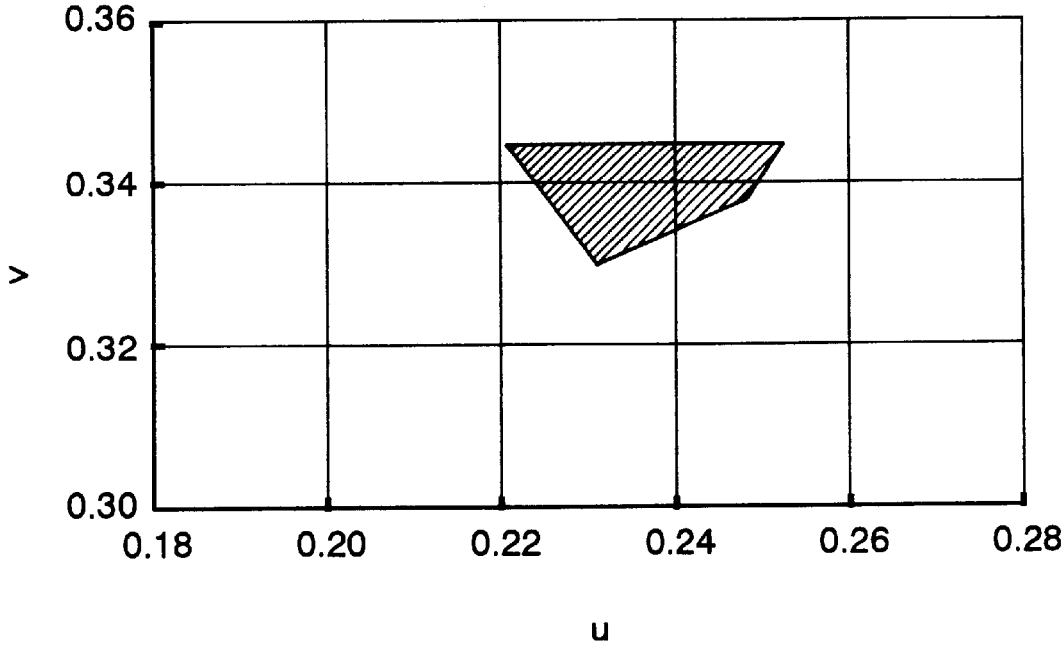
FIG. 10 is a diagram showing a chromatic range of colors of light sources that provide high perception of white color according to the CIE 1960 UCS diagram.

In the experiments, observers view an achromatic color chart having a Munsel value of 9 under lamps having light sources radiating different light colors, and judge how much chromatic color and how much white color they perceive the color of the color chart to contain, and answer their perception by giving points out of 100 points in proportion to the ratio of the chromatic color and white color. A hatched region in the CIE 1960 UCS diagram in FIG. 10 is shown as a range that can provide high perception of white color. For colors in the hatched region, the observers gave 90 points or more to white color. The region is bounded by lines connecting four color points (u, v)=(0.221, 0.345), (0.252, 0.345), (0.248, 0.338), and (0.231, 0.330) in the CIE 1960 UCS diagram. Thus, light sources whose light colors lie in this region permit a white object to be recognized as being white.

Figure 11:
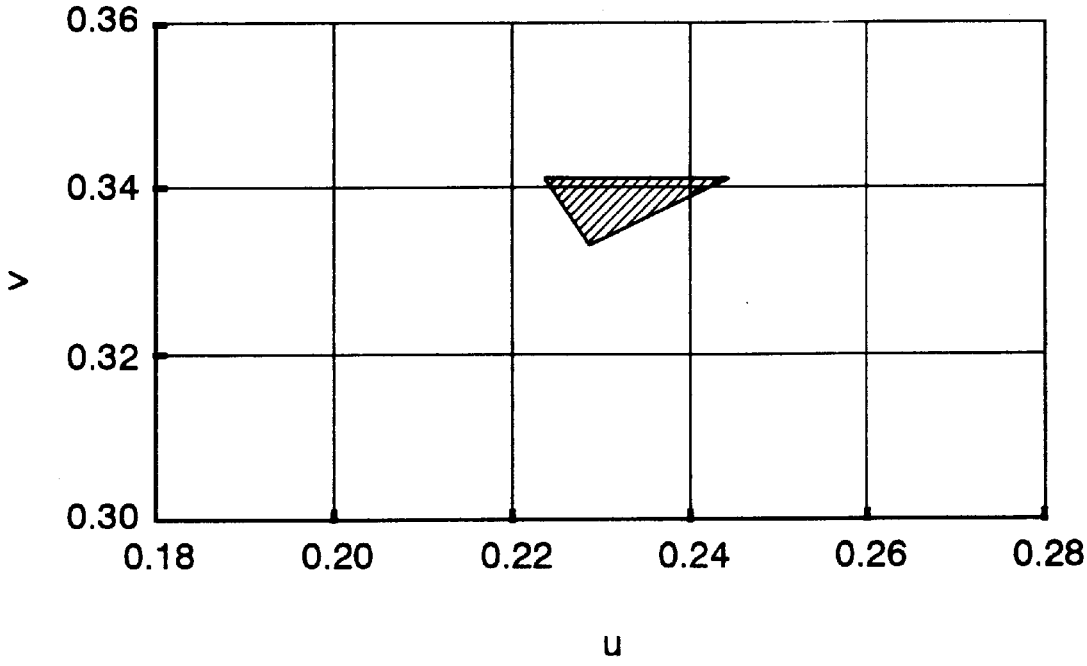
FIG. 11 is a diagram showing a chromatic range of colors of light sources that provide particularly high perception of white color according to the CIE 1960 UCS diagram

A region for light colors that provided perception of white color to a greater extent is shown as a hatched area in FIG. 11. The region shown in FIG. 11, which is bounded by lines connecting three color points (u, v)=(0.224, 0.341), (0.244, 0.341), and (0.229, 0.333) in the CIE 1960 UCS diagram, encompasses light colors that the observers gave 95 points or more for white color. Thus, light sources whose light colors lie in this region permit a white object to be recognized as being white more distinctly.

Another problem is glare of a light source. Glaring light not only causes discomfort to the eyes, but also interferes with accurate perception of the surroundings. The relationship between light colors of light sources and uncomfortable glare has been reported by Yano et al. in "Relationship between uncomfortable glare of the elderly and light color", Journal of Illumination Society, Vol. 77, No.6, 1993. It describes that the lower the color temperature is, the less uncomfortable glare is caused. Herein, an investigation was conducted with respect to glare level from light sources falling within a color temperature range that can be used for a headlight.

Experiments were conducted to study how much glare is caused by a light source by varying the correlated color temperature of light color of a light source. In the experiments, the observers identified the same brightness as they are dazzled when viewing a light source having 3000 K.

Figure 12:
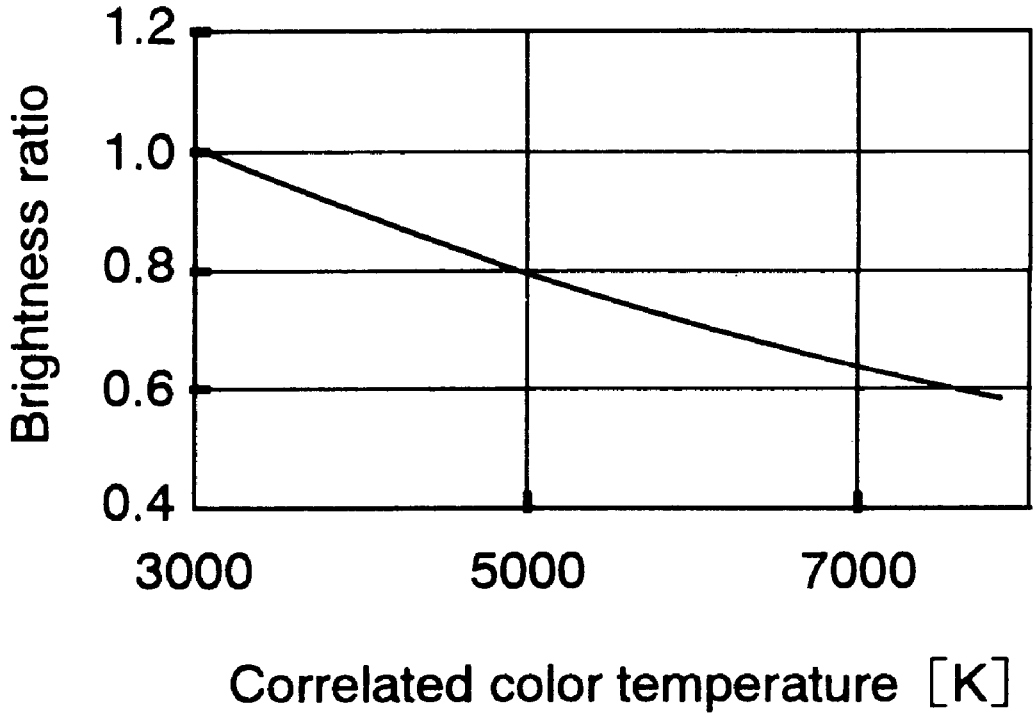
FIG. 12 is a graph showing the relationship between the correlated color temperature and the brightness of dazzling light sources.

Assuming the brightness of the light source with 3000 K as 1, the observers judged the brightness that dazzles the observers when viewing light sources having different correlated color temperatures. The results are shown in FIG. 12. The graph shown in FIG. 12 indicates that as the correlated color temperature (K) became higher, the brightness that dazzles the observers became lower.

As a result of further analysis, it was found that there is a significant difference in a significant level of 5% between the brightness that dazzled the observers when viewing a light source with a correlated temperature of 3800 K or less and the brightness that dazzled the observers when viewing a light source with a correlated temperature of 4000 K. More specifically, it was found that the uncomfortable glare caused by the light source with a correlated temperature of 3800 K or less is significantly reduced, compared with that caused by the light source with a correlated temperature of 4000 K.

Next, the observers evaluated the difference in light color between a halogen lamp with a color temperature of 3100 K and a light source with a different color temperature when the lamp and the light source were illuminated at 10000 cd/m$^2$ simultaneously.

Figure 13:
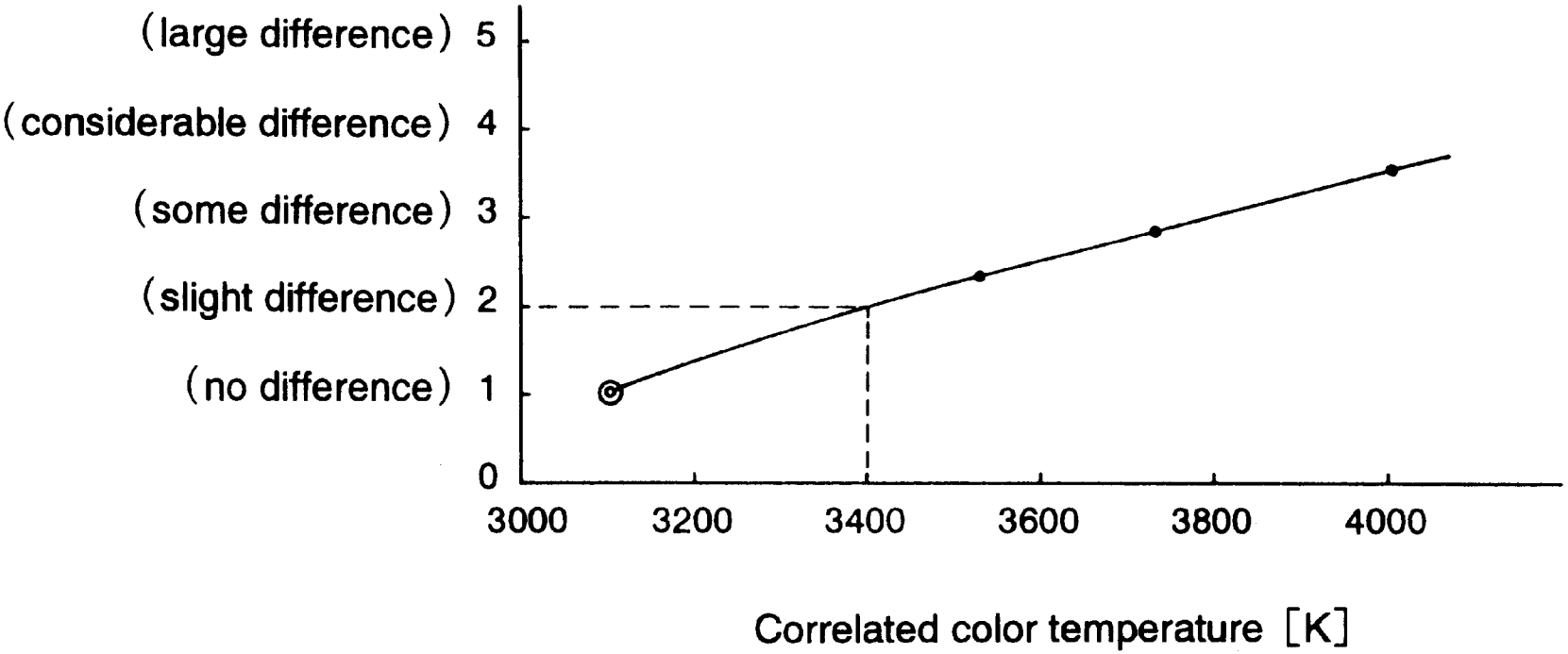
FIG. 13 is a graph showing the relationship between the correlated color temperature and the perception of the difference in the color of light between the present invention and a halogen lamp.

The light color difference was evaluated by a method in which the observers select one category out of 5 categories: "no difference", "slight difference", "some difference", "considerable difference", and "large difference". The results are shown in FIG. 13. These results confirmed that the difference in light color between the light of a lamp with a color temperature of 3400 K or more and the light of the halogen lamp can be recognized easily.

Thus, it was confirmed that the light color of a headlight with a correlated color temperature of 3400K or more can be discriminated against that of a headlight employing a current halogen lamp.

Figure 1:
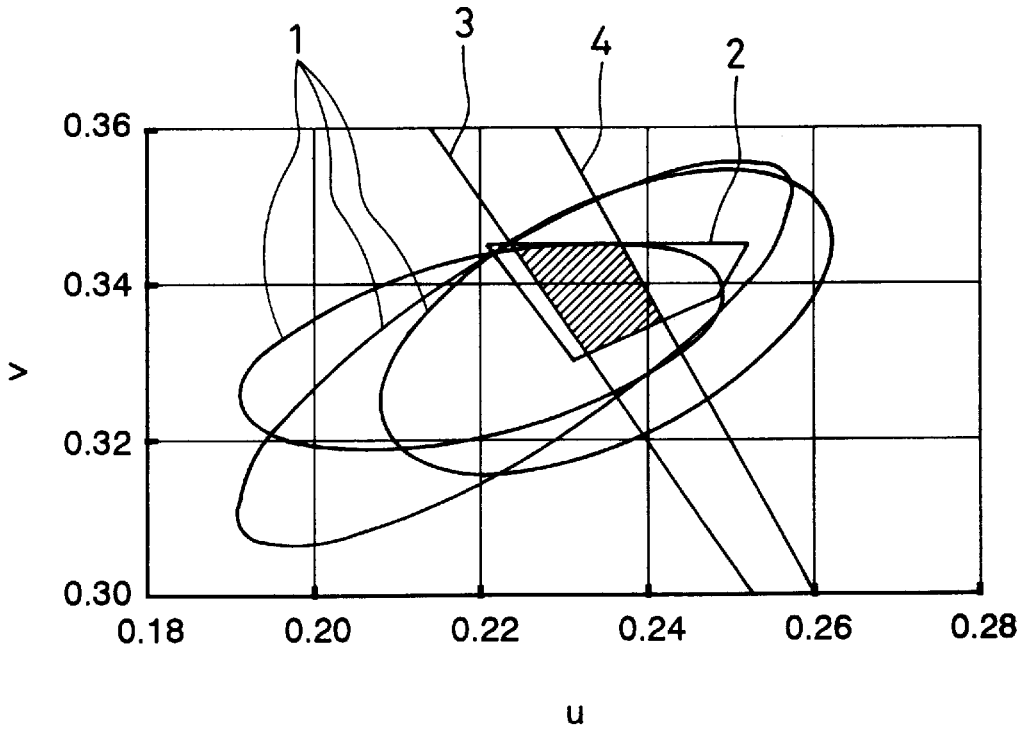
FIG. 1 is a diagram collectively showing a chromatic range of light colors that provide the effects of the present invention, i.e., excellent color discrimination, low levels of uncomfortable glare, high perception of white color, and high discrimination against the light color of a halogen lamp, according to the CIE 1960 UCS diagram.

The chromatic ranges having the effects of the present invention are collectively shown in the CIE 1960 UCS diagram in FIG. 1. In FIG. 1, chromatic ranges 1 encompass colors that provide excellent color discrimination. A chromatic range 2 encompasses colors that provide excellent perception of white color. A line 3 is an isotemperature line of a correlated color temperature of 3800 K, which is a boundary below which the illumination is hardly dazzling. A line 4 is an isotemperature line of a correlated color temperature of 3400 K, which is a boundary for easy recognition of the difference from the light color of a halogen lamp.

The light source with a low color temperature whose color lies in a range common to the range for excellent color discrimination and the range for excellent perception of white color of the present invention has a low color temperature and provides excellent color discrimination and perception of white color. When the color point of the above-described light source lies in a range on the side of color temperatures lower than the isotemperature line of a correlated color temperature of 3800K, the light is hardly dazzling, in addition to providing excellent color discrimination and perception of white color. Furthermore, when the color point of the above-described light source lies in a range on the side of color temperatures higher than the isotemperature line of a correlated color temperature of 3400K, the light is hardly dazzling, and the light color can be discriminated against that of a headlight employing a halogen lamp, in addition to providing excellent color discrimination and perception of white color.

Furthermore, a xenon gas is sealed in a luminous tube so as to improve the luminous flux rising characteristics. It is believed that this is because xenon is vapor at room temperature and emits visible light during discharge.

A preferable pressure of the xenon gas sealed is 5 atm or more and 20 atm or less. This allows the luminous flux rising characteristics to improve further and prevents a rupture of the luminous tube.

The hatched region in FIG. 1 is a range of light colors of light sources with low color temperature from 3400K to 3800K that provide excellent color discrimination and perception of white color.

The light source having the above-described effects is achieved by using a discharge lamp for a headlight comprising a luminous tube filled with a metal halide and a rare gas.

The discharge lamp includes a luminous tube provided with at least a pair of electrodes and filled with a metal halogen and a rare gas. The distance between the ends of the electrodes is 8 mm or less. The inner diameter D of the luminous tube at the midpoint between the electrodes is 5 mm or less. The power applied for illumination is 70 W or less. The lamp efficiency during illumination is 501 m/W or more. This structure of the discharge lamp can achieve a discharge lamp for headlights having the advantages of the present invention by suitably selecting the compositions and the amounts of the metal halide and the rare gas sealed, the distance d between the ends of the electrodes, and the inner diameter D of the luminous tube at the midpoint between the electrodes.

As for the metal halide, the discharge lamp for headlights having the advantages of the present invention can be achieved by containing at least 50 wt % of a halide of sodium on the basis of the total amount of the metal halide contained. This is because the halide of sodium provides the emission of red color with high efficiency. When the amount of the halide of sodium is lower than 50 wt %, the advantages of the present invention and the lamp efficiency of 501 m/W or more are not achieved at the same time.

Figure 14:
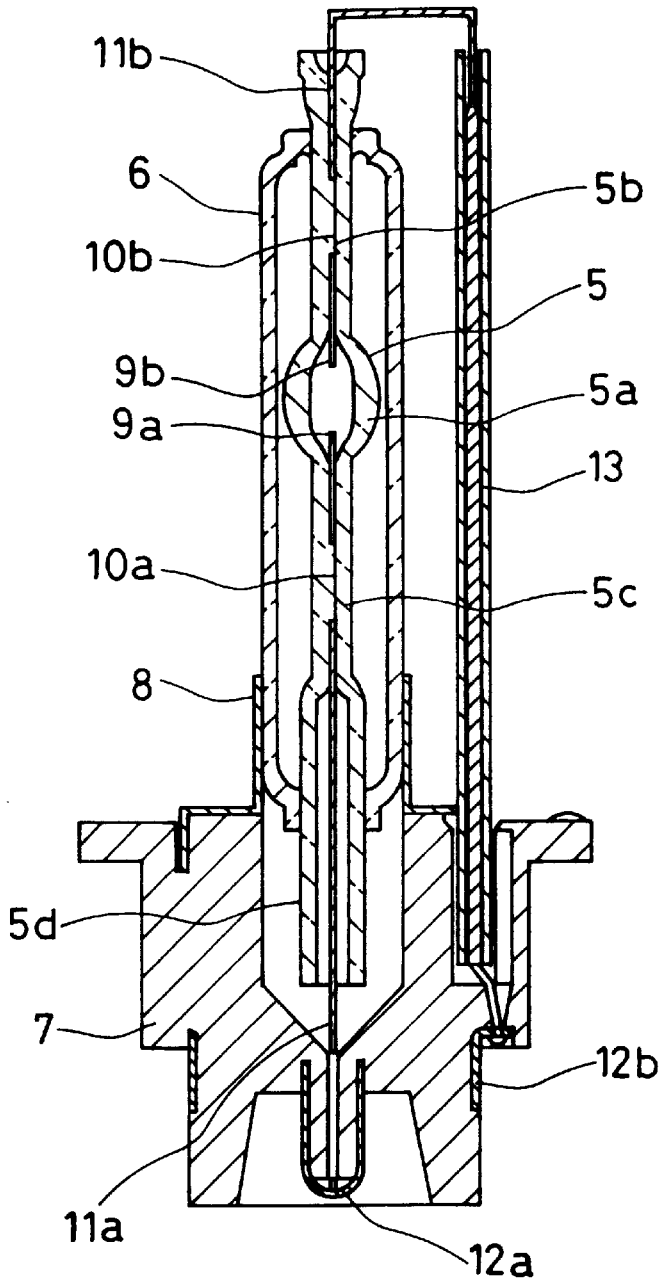
FIG. 14 is a front view partially showing a discharge lamp for a headlight of an embodiment of the present invention.

Hereinafter, the light sources of the present invention will be described by way of examples with reference to the accompanying drawings. FIG. 14 shows a discharge lamp of an embodiment of the present invention. A luminous tube 5 includes a luminescent part 5*a*, flat sealing parts 5*b* and 5*c* provided at the opposite ends of the luminescent part 5*a*, and a cylindrical part 5*d* connected to an end of the sealing part 5*c*. The end of the luminous tube 5 on the side of the cylindrical part 5*d* is inserted into the central part of a container 7 formed of a resin such as polyetherimide resin and retained in the container 7 with a retainer 8 formed of a conductor and an outer tube 6. The luminescent part 5*a* includes a pair of electrodes 9*a* and 9*b*, and mercury, a metal halide and xenon as a starting gas are sealed therein. Metal foils 10*a* and 10*b* are buried in the sealing parts 5*b* and 5*c*, respectively. An end of the electrode 9*a* is connected to one end of the metal foil 10*a* and the other end thereof is located in the luminescent part 5*a*. An end of an external lead 11*a* is connected to the other end of the metal foil 10*a*. The external lead 11*a* extends from the sealing part 5*c* through the cylindrical part 5*d* and is connected to a lamp base 12*a*. The metal foil 10*b*, the electrode 9*b*, and an external lead 11*b* are connected in the same manner, and the other end of the external lead 11*b* is connected to one end of a power supply line 13. The other end of the power supply line 13 is connected to a lamp base 12*b*. The outer tube 6 is fused to the ends of the luminous tube 5.

The discharge lamp shown in FIG. 14 has an inner volume of 0.025 cc and an arc length of 4.2 mm, and 50 mg of mercury, 10 atm of xenon gas and a metal halide are sealed in the luminous tube 5. As the metal halide, 0.2 mg of a mixture of scandium iodide and sodium iodide is contained in the luminous tube 5. The discharge lamps produced at various mixture ratios for the metal halide are allowed to illuminate at 35 W and 50 W. Table 1 shows the color points (u,v) at illumination at 35 W and 50 W, the lamp efficiency at 35 W illumination, and the luminous flux maintaining ratio after 1000 hour illumination at 35 W. In Tables 1 to 5, $W_{Na}$, $W_{Sc}$, $W_{Th}$, $W_{Tl}$ and $W_{Cs}$ represent the percentages by weight of the halide of sodium sealed, the halide of scandium sealed, the halide of thorium sealed, the halide of thallium sealed, and the halide of cesium, respectively, with respect to the total amount of the metal halide sealed.

TABLE 1

| | | $W_{Na}$ | $W_{Sc}$ | u, v (35W) | u, v (50W) | Lamp efficiency | Luminous flux maintaining ratio | Value for formula 1* |
|---|---|---|---|---|---|---|---|---|
| Ex. 1 | lamp A | 75 | 25 | 0.226, 0.336 | 0.231, 0.337 | 90 | 74 | 0.75 |
| Ex. 2 | lamp B | 80 | 20 | 0.203, 0.338 | 0.235, 0.338 | 88 | 80 | 0.80 |
| Ex. 3 | lamp C | 85 | 15 | 0.231, 0.338 | 0.239, 0.339 | 87 | 82 | 0.85 |
| Ex. 4 | lamp D | 90 | 10 | 0.236, 0.339 | 0.244, 0.340 | 85 | 84 | 0.90 |
| Ex. 5 | lamp E | 95 | 5 | 0.240, 0.338 | 0.247, 0.340 | 83 | 86 | 0.95 |
| Com. Ex. 1 | lamp F | 70 | 30 | 0.220, 0.333 | 0.226, 0.332 | 92 | 69 | 0.70 |
| Com. Ex. 2 | lamp G | 100 | 0 | 0.248, 0.346 | 0.253, 0.341 | 80 | 86 | 1.00 |

* formula 1: $0.75 \leqq W_{Na}/(W_{Sc} + W_{Na}) < 1$

Table 1 indicates that the discharge lamp for headlights having the advantages of the present invention can be achieved with lamp A at 35 W and 50 W, lamp B at 50 W, lamp C at 35 W and 50 W, lamp D at 35 W and lamp E at 35 W, which contain the metal halide satisfying formula 1: $0.75 \leqq W_{Na}/(W_{Sc}+W_{Na})<1$, when the power for illumination is suitably adjusted. It is preferable to seal the metal halide at a mixture ratio satisfying the relationship: $0.80 \leqq W_{Na}/(W_{Sc}+W_{Na})<1$. It is known that in a discharge lamp for headlights containing a halide of scandium, a reaction between scandium and quartz, which is a material component for the luminous tube, causes a reduction in the linear transmittance of the luminous tube, which is known as opacity. However, opacity can be prevented in the above-described range of the mixture ratio for the metal halide, so that a luminous flux maintaining ratio of 70% or more can be achieved after 1000 hour illumination at 35 W.

On the other hand, lamp F of Comparative Example 1 at 35 W and 50 W illumination is outside of the hatched region of FIG. 1, and has a value of formula 1 outside of the lower limit, and therefore is not preferable. Lamp G of Comparative Example 2 at 35 W and 50 W illumination is outside of the hatched region of FIG. 1, and has a value of formula 1 outside of the range of formula 1, and therefore is not preferable.

Furthermore, the same discharge lamp as shown in FIG. 14 is used, and as the metal halide, 0.2 mg of a mixture of scandium iodide, sodium iodide and thorium iodide is contained in the luminous tube 5. The discharge lamps produced at various mixture ratios for the metal halide are allowed to illuminate at 35 W and 50 W. Table 2 shows the color points (u,v) at illumination at 35 W and 50 W, the lamp efficiency at 35 W illumination, and the luminous flux maintaining ratio after 1000 hour illumination at 35 W

TABLE 2

| | | $W_{Na}$ | $W_{Sc}$ | $W_{Th}$ | u, v (35W) | u, v (50W) | Lamp efficiency | Luminous flux maintaining ratio | Value for formula 2** |
|---|---|---|---|---|---|---|---|---|---|
| Ex. 6 | lamp H | 80 | 19 | 1 | 0.226, 0.336 | 0.235, 0.339 | 86 | 81 | 0.80 |
| Ex. 7 | lamp I | 80 | 18 | 2 | 0.227, 0.334 | 0.235, 0.339 | 86 | 82 | 0.80 |
| Ex. 8 | lamp J | 80 | 15 | 5 | 0.220, 0.330 | 0.231, 0.338 | 83 | 80 | 0.79 |
| Ex. 9 | lamp K | 95 | 4 | 1 | 0.240, 0.338 | 0.245, 0.340 | 81 | 88 | 0.95 |
| Ex. 10 | lamp L | 95 | 3 | 2 | 0.238, 0.337 | 0.244, 0.339 | 80 | 86 | 0.95 |
| Ex. 11 | lamp M | 95 | 0 | 5 | 0.236, 0.337 | 0.244, 0.336 | 78 | 85 | 0.95 |
| Com. Ex. 3 | lamp N | 80 | 10 | 10 | 0.220, 0.330 | 0.238; 0.331 | 84 | 88 | 0.73 |

**formula 2: $0.75 \leqq [W_{Na}/(W_{Sc}\ 30\ W_{Na})] - [W_{Th}/(W_{Sc} + W_{Na} + W_{Th})] < 1$ Table 2 indicates that the discharge lamp for headlights having the advantages of the present invention can be achieved with lamp H at 50 W, lamp I at 50 W, lamp J at 50 W, lamp K at 35 W and 50 W, lamp L at 35 W and 50 W, and lamp M at 35 W and 50 W, which contain the metal halide satisfying formula 2: $0.75 \leqq W_{Na}/(W_{Sc}+W_{Na}-W_{Th}/(W_{Sc}+W_{Na}+W_{Th})<1$, when the power for illumination is suitably adjusted.

On the other hand, lamp N of Comparative Example 3 at 35 W and 50 W illumination is outside of the hatched region of FIG. 1, and has a value of formula 2 outside of the lower limit, and therefore is not preferable.

Furthermore, the same discharge lamp as shown in FIG. 14 is used, and as the metal halide, 0.2 mg of a mixture of scandium iodide, sodium iodide and thallium iodide is contained in the luminous tube 5. The discharge lamps produced at various mixture ratios for the metal halide are allowed to illuminate at 35 W and 50 W. Table 3 shows the color points (u,v) at illumination at 35 W and 50 W, the lamp efficiency at 35 W illumination, and the luminous flux maintaining ratio after 1000 hour illumination at 35 W which contain the metal halide satisfying formulae 1 and 3: $0.75 \leqq W_{Na}/(W_{Sc}+W_{Na})<1$ (formula 1) and $W_{Tl}/(W_{Sc}+W_{Na}+W_{Tl}) \leqq 0.03$ (formula 3), when the power for illumination is suitably adjusted.

On the other hand, lamps S and T of Comparative Examples 4 and 5 at 35 W and 50 W illumination is outside of the hatched region of FIG. 1, and has a value of formula 1 outside of the lower limit, and therefore is not preferable. Lamp U of Comparative Example 6 at 35 W and 50 W illumination is outside of the hatched region of FIG. 1, and has values outside of the ranges of formulae 1 and 2, and therefore is not preferable. Lamp W of Comparative Example 7 at 35 W and 50 W illumination is outside of the hatched region of FIG. 1, and has a value outside of the range of formula 2, and therefore is not preferable.

Furthermore, the same discharge lamp as shown in FIG. 14 is used, and as the metal halide, 0.2 mg of a mixture of scandium iodide, sodium iodide, thorium iodide and thallium iodide is contained in the luminous tube 5. The discharge lamps at various mixture ratios for the metal halide are allowed to illuminate at 35 W and 50 W. Table 4 shows the color points (u,v) at illumination at 35 W and 50 W, the lamp efficiency at 35 W illumination, and the luminous flux maintaining ratio after 1000 hour illumination at 35 W.

TABLE 3

| | | $W_{Na}$ | $W_{Sc}$ | $W_{Tl}$ | u, v (35W) | u, v (50W) | Lamp efficiency | Luminous flux maintaining ratio | Value for formula 1* | Value for formula 3** |
|---|---|---|---|---|---|---|---|---|---|---|
| Ex. 12 | lamp O | 80 | 18 | 2 | 0.226, 0.339 | 0.232, 0.346 | 89 | 81 | 0.82 | 0.02 |
| Ex. 13 | lamp P | 80 | 17 | 3 | 0.226, 0.341 | 0.232, 0.341 | 91 | 80 | 0.82 | 0.03 |
| Ex. 14 | lamp Q | 95 | 3 | 2 | 0.239, 0.342 | 0.243, 0.343 | 84 | 86 | 0.97 | 0.02 |
| Ex. 15 | lamp R | 95 | 2 | 3 | 0.238, 0.343 | 0.245, 0.340 | 85 | 88 | 0.98 | 0.03 |
| Com. Ex.4 | lamp S | 70 | 28 | 2 | 0.218, 0.338 | 0.225, 0.346 | 93 | 70 | 0.71 | 0.02 |
| Com. Ex. 5 | lamp T | 70 | 27 | 3 | 0.218, 0.340 | 0.224, 0.350 | 95 | 68 | 0.72 | 0.03 |
| Com. Ex. 6 | lamp U | 70 | 25 | 5 | 0.217, 0.343 | 0.221, 0.360 | 95 | 70 | 0.74 | 0.05 |
| Com. Ex. 7 | lamp V | 80 | 15 | 5 | 0.224, 0.344 | 0.230, 0.348 | 91 | 81 | 0.84 | 0.05 |

*formula 1: $0.75 \leqq W_{Na}/(W_{Sc} + W_{Na}) < 1$
**formula 3: $W_{Tl}/(W_{Sc} + W_{Na} + W_{Tl}) \leqq 0.03$ Table 3 indicates that the discharge lamp for headlights having the advantages of the present invention can be achieved with lamp 0 at 35 W, lamp P at 35 W and 50 W, lamp Q at 35 W and 50 W, and lamp R at 35 W and 50 W,

TABLE 4

| | | $W_{Na}$ | $W_{Sc}$ | $W_{Th}$ | $W_{Tl}$ | u, v (35W) | u, v (50W) | E. | M. | 2** | 4*** |
|---|---|---|---|---|---|---|---|---|---|---|---|
| Ex. 16 | lamp a | 80 | 13 | 5 | 2 | 0.224, 0.338 | 0.229, 0.337 | 88 | 81 | 0.81 | 0.01 |
| Ex. 17 | lamp b | 80 | 10 | 5 | 5 | 0.220, 0.340 | 0.227, 0.341 | 90 | 79 | 0.84 | −0.05 |
| Ex. 18 | lamp c | 85 | 5 | 5 | 5 | 0.224, 0.342 | 0.231, 0.341 | 88 | 81 | 0.89 | −0.05 |
| Ex. 19 | lamp d | 85 | 0 | 5 | 10 | 0.221, 0.347 | 0.226, 0.345 | 91 | 80 | 0.91 | −0.05 |
| Ex. 20 | lamp e | 85 | 0 | 10 | 2 | 0.221, 0.337 | 0.230, 0.337 | 86 | 81 | 0.89 | 0.06 |
| Ex. 21 | lamp f | 90 | 3 | 5 | 2 | 0.231, 0.338 | 0.237, 0.339 | 83 | 83 | 0.92 | 0.01 |
| Ex. 22 | lamp g | 90 | 0 | 5 | 5 | 0.229, 0.342 | 0.235, 0.341 | 85 | 81 | 0.95 | −0.05 |
| Com. Ex. 9 | lamp h | 80 | 5 | 5 | 10 | 0.217, 0.348 | 0.223, 0.350 | 90 | 78 | 0.89 | −0.14 |

E.: lamp efficiency
M.: Luminous flux maintaining ratio/
2**: value for formula 2: $0.75 \leqq W_{Na}/(W_{Sc}+W_{Na}) - W_{Th}/(W_{Sc}+W_{Na}+W_{Th}) < 1$
4***: value for formula 4: $-0.05 \leqq W_{Th}/(W_{Sc}+W_{Na}+W_{Th}) - 2 \times W_{Tl}/(W_{Sc}+W_{Na}+W_{Th}+W_{Tl})$ Table 4 indicates that the discharge lamp for headlights having the advantages of the present invention can be achieved with lamp a at 50 W, lamp b at 50 W, lamp c at 50 W, lamp d at 50 W, lamp e at 50 W, lamp f at 35 W and 50 W, and lamp g at 35 W and 50 W, which contain the metal halide satisfying formulae 2 and 4: $0.75 \leqq W_{Na}/(W_{Sc}+W_{Na}-W_{Th}/(W_{Sc}W_{Na}+W_{Th})<1$ (formula 2) and $-0.05 \leqq W_{Th}/(W_{Sc}+W_{Na}+W_{Th})-2\times W_{Tl}/(W_{Sc}+W_{Na}+W_{Th}+W_{Tl})$ (formula 4), when the power for illumination is suitably adjusted.

On the other hand, lamp h of Comparative Example 8 at 35 W and 50 W illumination is outside of the hatched region of FIG. 1, and has a value outside of the range of formula 4, and therefore is not preferable.

Furthermore, the same discharge lamp as shown in FIG. 14 is used, and as the metal halide, 0.2 mg of a mixture of scandium iodide, sodium iodide, thorium iodide, thallium iodide and cesium iodide is contained in the luminous tube 5. The discharge lamps produced at various mixture ratios are allowed to illuminate at 35 W and 50 W. Table 5 shows the color points (u,v) at illumination at 35 W and 50 W, the lamp efficiency at 35 W illumination, and the luminous flux maintaining ratio after 1000 hour illumination at 35 W.

flux maintaining ratio during lifetime along with the advantages of the present invention can be obtained by using cesium. However, as the amount of cesium halide increase, the lamp efficiency decreases. Thus, in lamp n and lamp o of Comparative Examples 9 and 10, where the amount of cesium halide contained exceeds 10 wt %, the lamp efficiency is below 50 lm/W. As a result, it is preferable that the amount of cesium halide contained is 10 wt % or less, which achieves a lamp efficiency of 50 lm/W.

When the outer tube of the discharge lamp has a linear transmittance of 30% or less for light at 350 nm and a linear transmittance of 70% or more for light at 450 nm, the discharge lamp for headlights having the advantages of the present invention is further advantageous in that harmful ultraviolet radiation, which degrades the illumination equipment, can be reduced. As a material for this outer tube, a quartz glass material is used preferably. The quartz glass has high linear transmittance for visible light and excellent heat resistance, so that a discharge lamp for headlights having high efficiency and excellent heat resistance results. Furthermore, it is preferable that this quartz glass comprises

TABLE 5

| | | $W_{Na}$ | $W_{Sc}$ | $W_{Th}$ | $W_{Tl}$ | $W_{Ca}$ | u, v (35W) | u, v (50W) | E | M | 2** | 4*** |
|---|---|---|---|---|---|---|---|---|---|---|---|---|
| Ex. 23 | lamp i | 85 | 13 | 1 | 1 | 0 | 0.231, 0.339 | 0.237, 0.339 | 90 | 79 | 0.86 | −0.01 |
| Ex. 24 | lamp j | 85 | 8 | 1 | 1 | 5 | 0.231, 0.337 | 0.229, 0.339 | 72 | 86 | 0.90 | −0.01 |
| Ex. 25 | lamp k | 80 | 13 | 5 | 2 | 0 | 0.224, 0.338 | 0.228, 0.337 | 88 | 81 | 0.81 | 0.01 |
| Ex. 26 | lamp l | 80 | 8 | 5 | 2 | 5 | 0.224, 0.335 | 0.231, 0.337 | 68 | 86 | 0.86 | 0.01 |
| Ex. 27 | lamp m | 80 | 3 | 5 | 2 | 10 | 0.224, 0.336 | 0.230, 0.338 | 55 | 88 | 0.91 | 0.01 |
| Com. Ex.9 | lamp n | 80 | 0 | 5 | 2 | 13 | 0.225, 0.334 | 0.229, 0.338 | 45 | 88 | 0.94 | 0.01 |
| Com. Ex. 10 | lamp o | 85 | 2 | 1 | 1 | 11 | 0.233, 0.339 | 0.238, 0.340 | 49 | 88 | 0.97 | −0.01 |

E: lamp efficiency
M: Luminous flux maintaining ratio
2**: value for formula 2: $0.75 \leqq W_{Na}/(W_{Sc}+W_{Na}) - W_{Th}/(W_{Sc}+W_{Na}+W_{Th}) < 1$
4***: value for formula 4: $-0.05 \leqq W_{Th}/(W_{Sc}+W_{Na}+W_{Th}) - 2 \times W_{Tl}/(W_{Sc}+W_{Na}+W_{Th}+W_{Tl})$ Table 5 indicates that the discharge lamp for headlights having the advantages of the present invention can be achieved with lamp i at 50 W, lamp j at 50 W, lamp k at 50 W, lamp l at 35 W and 50 W, and lamp m at 35 W and 50 W, which contain the metal halide satisfying formulae 2 and 4: $0.75 \leqq W_{Na}/(W_{Sc}+W_{Na})-W_{Th}/(W_{Sc}+W_{Na}+W_{Th})<1$ (formula 2) and $-0.05 \leqq W_{Th}/(W_{Sc}+W_{Na}+W_{Th})-2\times W_{Ti}/(W_{Sc}+W_{Na}+W_{Th}+W_{Ti})$ (formula 4), when the power for illumination is suitably adjusted. Thus, it was found that a discharge lamp for headlights having an increased luminous at least one element selected from the group consisting of cerium oxide, titanium oxide, iron oxide, praseodymium oxide and europium oxide. The quartz glass comprising at least one of these elements has the effect of reducing the linear transmittance for ultraviolet rays at a wavelength of 380 nm or less while maintaining the linear transmittance for visible light at 380 to 780 nm. Thus, the use of the quartz glass comprising at least one of these elements as the outer tube provides a discharge lamp for headlights with harmful ultraviolet radiation being reduced.

When the outer tube seals the luminous tube at least at one end thereof, the discharge lamp for headlights can provide excellent color discrimination, and is hardly dazzling during illumination.

When the inner volume of the outer tube is 12 mm or less, the discharge lamp for headlights can radiate light with a constant light color and luminous flux due to a reduced variation in the temperature of the coldest point of the luminous tube depending on the illumination conditions. In the examples of the present invention, iodides have been described as the metal halide. However, other halides such as bromides or combinations thereof can provides the same effects.

The object of the present invention of providing a discharge lamp for headlights under which the colors of various illuminated chromatic objects can be perceived properly and whose uncomfortable glare is reduced can be achieved by using an outer tube that absorbs visible light selectively so that the light from the light source has desired chromaticity.

The object of the present invention of providing a discharge lamp for headlights under which the colors of various illuminated chromatic objects can be perceived properly and whose uncomfortable glare is reduced also can be achieved by using headlight equipment including at least one of a transparent plate and a reflecting plate that provides the light of the light source with desired chromaticity.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A discharge lamp for an automobile headlight comprising:

a luminous tube in which xenon gas and metal halide are sealed, whose light color lies in a chromatic region common to the following three regions:

a region bounded by an ellipse with a color point (u, v)=(0.224, 0.331) as a center thereof, a major axis of 0.080, a minor axis of 0.024, and an angle from a u axis of 35 degrees in the CIE 1960 UCS diagram;

a region bounded by an ellipse with a color point (u, v)=(0.220, 0.332) as a center thereof, a major axis of 0.060, a minor axis of 0.022, and an angle from a u axis of 15 degrees in the CIE 1960 UCS diagram; and a region bounded by an ellipse with a color point (u, v)=(0.235, 0.335) as a center thereof, a major axis of 0.060, a minor axis of 0.030, and an angle from a u axis of 30 degrees in the CIE 1960 UCS diagram; and at least a pair of electrodes, wherein a distance d between ends of the electrodes is 8 mm or less, an inner diameter D of the luminous tube at a midpoint between the electrodes is 5 mm or less, a power W supplied for illumination is 70 W or less, and a lamp efficiency during illumination is 50 lm/W or more.

2. The discharge lamp for an automobile headlight according to claim 1, wherein the light color lies in a region bounded by lines connecting four color points (u, v) of (0.221, 0.345), (0.252, 0.345), (0.248, 0.338), and (0.231, 0.330) in the CIE 1960 UCS diagram.

3. The discharge lamp for an automobile headlight according to claim 1, wherein the light color lies in a region bounded by lines connecting three color points (u, v) of (0.224, 0.341), (0.244, 0.341), and (0.229, 0.333) in the CIE 1960 UCS diagram.

4. The discharge lamp for an automobile headlight according to claim 1, wherein the light color lies in a range on a side of color temperature lower than an isotemperature line of a correlated color temperature of 3800K in the CIE 1960 UCS diagram.

5. The discharge lamp for an automobile headlight according to claim 1, wherein the light color lies in a range on a side of color temperature higher than an isotemperature line of a correlated color temperature of 3400K in the CIE 1960 UCS diagram.

6. A headlight for an automobile comprising the discharge lamp for an automobile headlight according to claim 1.

7. The discharge lamp for an automobile headlight according to claim 1, wherein the metal halide comprises a halide of sodium, and an amount of the halide of sodium sealed is 50 wt % or more with respect to a total amount of the metal halide sealed.

8. The discharge lamp for an automobile headlight according to claim 7, wherein the metal halide comprises 10 wt % or less of a halide of cesium with respect to a total amount of the metal halide sealed.

9. The discharge lamp for an automobile headlight according to claim 7 comprising an outer tube having a linear transmittance for light at 350 nm of 30% or less and a linear transmittance for light at 450 nm of 70% or more.

10. The discharge lamp for an automobile headlight according to claim 9, wherein the outer tube seals at least one end of the luminous tube.

11. The discharge lamp for an automobile headlight according to claim 9, wherein an inner diameter of the outer tube is 12 mm or less.

12. The discharge lamp for an automobile headlight according to claim 1, wherein the metal halide comprises a halide of sodium and a halide of scandium, and does not comprise a halide of thorium nor a halide of thallium, and the following relationship is satisfied:

$$90 < W_{Na} + W_{Sc}, \text{ and}$$

$$0.75 \leqq W_{Na}/(W_{Sc} + W_{Na}) < 1,$$

where $W_{Na}$ and $W_{Sc}$ represent percentages by weight of the halide of sodium sealed, and the halide of scandium sealed, respectively, with respect to a total amount of the metal halide sealed.

13. The discharge lamp for an automobile headlight according to claim 1, wherein the metal halide comprises a halide of sodium, a halide of scandium and a halide of thorium, and does not comprise a halide of thallium, and the following relationship is satisfied:

$$90 < W_{Na} + W_{Sc} + W_{Th}, \text{ and}$$

$$0.75 \leqq [W_{Na}/(W_{Sc} + W_{Na})] - [W_{Th}/(W_{Sc} + W_{Na} + W_{Th})] < 1,$$

where $W_{Na}$, $W_{Sc}$ and $W_{Th}$ represent percentages by weight of the halide of sodium sealed, the halide of scandium sealed, and the halide of thorium sealed, respectively, with respect to a total amount of the metal halide sealed.

14. The discharge lamp for an automobile headlight according to claim 1, wherein the metal halide comprises a halide of sodium, a halide of scandium and a halide of thallium, and does not comprise a halide of thorium, and the following relationship is satisfied:

$$90<W_{Na}+W_{Sc}+W_{Tl},$$

$$0.75\leqq W_{Na}/(W_{Sc}+W_{Na})<1, \text{ and}$$

$$W_{Tl}/(W_{Sc}+W_{Na}+W_{Tl})\leqq 0.03,$$

where $W_{Na}$, $W_{Sc}$ and $W_{Tl}$ represent percentages by weight of the halide of sodium sealed, the halide of scandium sealed, and the halide of thallium sealed, respectively, with respect to a total amount of the metal halide sealed.

15. The discharge lamp for an automobile headlight according to claim 1, wherein the metal halide comprises a halide of sodium, a halide of scandium, a halide of thorium, and a halide of thallium, and the following relationship is satisfied:

$$90<W_{Na}+W_{Sc}+W_{Th}+W_{Tl},$$

$$0.75\leqq[W_{Na}/(W_{Sc}+W_{Na})]-[W_{Th}/(W_{Sc}+W_{Na}+W_{Th})]<1, \text{ and}$$

$$-0.05\leqq[W_{Th}/(W_{Sc}+W_{Na}+W_{Th})]-2\times[W_{Tl}/(W_{Sc}+W_{Na}+W_{Th}+W_{Tl}],$$

where $W_{Na}$, $W_{Sc}$, $W_{Th}$ and $W_{Tl}$ represent percentages by weight of the halide of sodium sealed, the halide of scandium sealed, the halide of thorium sealed and the halide of thallium sealed, respectively, with respect to a total amount of the metal halide sealed.

16. A discharge lamp for an automobile headlight comprising:

a luminous tube in which xenon gas and metal halide are sealed, whose light color lies in a chromatic region common to the following three regions:

a region bounded by an ellipse with a color point (u, v)=(0.221, 0.329) as a center thereof, a major axis of 0.047, a minor axis of 0.014, and an angle from a u axis of 35 degrees in the CIE 1960 UCS diagram;

a region bounded by an ellipse with a color point (u, v)=(0.224, 0.334) as a center thereof, a major axis of 0.040, a minor axis of 0.013, and an angle from a u axis of 15 degrees in the CIE 1960 UCS diagram; and a region bounded by an ellipse with a color point (u, v)=(0.236, 0.339) as a center thereof, a major axis of 0.037, a minor axis of 0.013, and an angle from a u axis of 30 degrees in the CIE 1960 UCS diagram; and at least a pair of electrodes, wherein a distance d between ends of the electrodes is 8 mm or less, an inner diameter D of the luminous tube at a midpoint between the electrodes is 5 mm or less, a power W supplied for illumination is 70 W or less, and a lamp efficiency during illumination is 50 lm/W or more.

17. The discharge lamp for an automobile headlight according to claim 16, wherein the light color lies in a region bounded by lines connecting four color points (u, v) of (0.221, 0.345), (0.252, 0.345), (0.248, 0.338), and (0.231, 0.330) in the CIE 1960 UCS diagram.

18. The discharge lamp for an automobile headlight according to claim 16, wherein the light color lies in a region bounded by lines connecting three color points (u, v) of (0.224, 0.341), (0.244, 0.341), and (0.229, 0.333) in the CIE 1960 UCS diagram.

19. The discharge lamp for an automobile headlight according to claim 16, wherein the light color lies in a range on a side of color temperature lower than an isotemperature line of a correlated color temperature of 3800K in the CIE 1960 UCS diagram.

20. The discharge lamp for an automobile headlight according to claim 16, wherein the light color lies in a range on a side of color temperature higher than an isotemperature line of a correlated color temperature of 3400K in the CIE 1960 UCS diagram.

21. A headlight for an automobile comprising the discharge lamp for an automobile headlight according to claim 16.

22. The discharge lamp for an automobile headlight according to claim 16, wherein the metal halide comprises a halide of sodium, and an amount of the halide of sodium sealed is 50 wt % or more with respect to a total amount of the metal halide sealed.

23. The discharge lamp for an automobile headlight according to claim 16, wherein the metal halide comprises a halide of sodium and a halide of scandium, and does not comprise a halide of thorium nor a halide of thallium, and the following relationship is satisfied:

$$90<W_{Na}+W_{Sc}, \text{ and}$$

$$0.75\leqq W_{Na}/(W_{Sc}+W_{Na})<1,$$

where $W_{Na}$ and $W_{Sc}$ represent percentages by weight of the halide of sodium sealed, and the halide of scandium sealed, respectively, with respect to a total amount of the metal halide sealed.

24. The discharge lamp for an automobile headlight according to claim 16, wherein the metal halide comprises a halide of sodium, a halide of scandium and a halide of thorium, and does not comprise a halide of thallium, and the following relationship is satisfied:

$$90<W_{Na}+W_{Sc}+W_{Th}, \text{ and}$$

$$0.75\leqq[W_{Na}/(W_{Sc}+W_{Na})]-[W_{Th}/(W_{Sc}+W_{Na}+W_{Th})]<1,$$

where $W_{Na}$, $W_{Sc}$ and $W_{Th}$ represent percentages by weight of the halide of sodium sealed, the halide of scandium sealed, and the halide of thorium sealed, respectively, with respect to a total amount of the metal halide sealed.

25. The discharge lamp for an automobile headlight according to claim 16, wherein the metal halide comprises a halide of sodium, a halide of scandium and a halide of thallium, and does not comprise a halide of thorium, and the following relationship is satisfied:

$$90<W_{Na}+W_{Sc}+W_{Tl},$$

$$0.75\leqq W_{Na}/(W_{Sc}+W_{Na})<1, \text{ and}$$

$$W_{Tl}/(W_{Sc}+W_{Na}+W_{Tl})<0.03,$$

where $W_{Na}$, $W_{Sc}$ and $W_{Tl}$ represent percentages by weight of the halide of sodium sealed, the halide of scandium sealed, and the halide of thallium sealed, respectively, with respect to a total amount of the metal halide sealed.

26. The discharge lamp for an automobile headlight according to claim 16, wherein the metal halide comprises a halide of sodium, a halide of scandium, a halide of thorium, and a halide of thallium, and the following relationship is satisfied:

$$90<W_{Na}+W_{Sc}+W_{Th}+W_{Tl},$$

$$0.75 \leqq [W_{Na}/(W_{Sc}+W_{Na})]-[W_{Th}/(W_{Sc}+W_{Na}+W_{Th})]<1, \text{ and}$$

$$-0.05 \leqq [W_{Th}/(W_{Sc}+W_{Na}+W_{Th})]-2\times[W_{Tl}/(W_{Sc}+W_{Na}+W_{Th}+W_{Tl})],$$

where $W_{Na}$, $W_{Sc}$, $W_{Th}$ and $W_{Tl}$ represent percentages by weight of the halide of sodium sealed, the halide of scandium sealed, the halide of thorium sealed and the halide of thallium sealed, respectively, with respect to a total amount of the metal halide sealed.

27. The discharge lamp for an automobile headlight according to claim 16, wherein the metal halide comprises 10 wt % or less of a halide of cesium with respect to a total amount of the metal halide sealed.

28. The discharge lamp for an automobile headlight according to claim 16, comprising an outer tube having a linear transmittance for light at 350 nm of 30% or less and a linear transmittance for light at 450 nm of 70% or more.

29. The discharge lamp for an automobile headlight according to claim 16, wherein the outer tube seals at least one end of the luminous tube.

30. The discharge lamp for an automobile headlight according to claim 16, wherein an inner diameter of the outer tube is 12 mm or less.

* * * * *